US007922058B2

(12) United States Patent
Jian

(10) Patent No.: US 7,922,058 B2
(45) **Date of Patent: *Apr. 12, 2011**

(54) NAIL GUN WITH AN ANGLE-ADJUSTABLE MAGAZINE

(75) Inventor: Jia-Liang Jian, Taichung Hsien (TW)

(73) Assignee: Rexon Industrial Corp., Ltd., Taichung Hsien (TW)

( * ) Notice: Subject to any disclaimer, the term of this patent is extended or adjusted under 35 U.S.C. 154(b) by 137 days.

This patent is subject to a terminal disclaimer.

(21) Appl. No.: 12/194,409

(22) Filed: Aug. 19, 2008

(65) Prior Publication Data

US 2009/0050668 A1 Feb. 26, 2009

(30) Foreign Application Priority Data

Aug. 21, 2007 (TW) ..... 96130892 A

(51) Int. Cl.
*B25C 1/00* (2006.01)

(52) U.S. Cl. ..... 227/126; 227/120; 227/119

(58) Field of Classification Search ..... 227/126, 227/120, 119

See application file for complete search history.

(56) References Cited

U.S. PATENT DOCUMENTS

| | | | | |
|---|---|---|---|---|
| 3,670,941 | A * | 6/1972 | Grinnell et al. | 227/8 |
| 4,566,621 | A * | 1/1986 | Becht | 227/109 |
| 4,746,047 | A * | 5/1988 | Boiko et al. | 227/120 |
| 5,626,274 | A * | 5/1997 | Shkolnikov et al. | 227/109 |
| 6,431,428 | B1 * | 8/2002 | Chen | 227/120 |
| 6,880,739 | B1 * | 4/2005 | Zhu | 227/109 |
| 7,025,242 | B1 * | 4/2006 | Schnell | 227/120 |
| 7,240,818 | B1 * | 7/2007 | Ho | 227/109 |
| 2006/0102683 | A1 * | 5/2006 | Schnell et al. | 227/119 |
| 2006/0102685 | A1 * | 5/2006 | Phillips et al. | 227/120 |
| 2009/0045239 | A1 * | 2/2009 | Jian | 227/120 |
| 2009/0050665 | A1 * | 2/2009 | Jian et al. | 227/119 |

* cited by examiner

*Primary Examiner* — Brian D Nash

(74) *Attorney, Agent, or Firm* — Stephen A. Bent; Foley & Lardner LLP

(57) ABSTRACT

A nail gun includes a body, a handle, a nail ejection member, a magazine member connected pivotally to the nail ejection member, and a connecting rod having an upper end connected pivotally to an end of the handle. One of the connecting rod and the magazine member is connectable with a selected one of first and second positioning portions of the other of the connecting rod and the magazine member to allow the magazine member to change between horizontal and inclined positions. In the horizontal position, a free end of the magazine member is spaced apart from the end of the handle. In the inclined position, the free end of the magazine member is adjacent to the end of the handle, and the connecting rod abuts against the magazine member along a full length thereof.

17 Claims, 17 Drawing Sheets

NAIL GUN WITH AN ANGLE-ADJUSTABLE MAGAZINE

CROSS-REFERENCE TO RELATED APPLICATION

This application claims priority of Taiwanese Application No. 096130892, filed on Aug. 21, 2007.

BACKGROUND OF THE INVENTION

1. Field of the Invention

This invention relates to a nail gun, and more particularly to a nail gun having an angle-adjustable magazine.

2. Description of the Related Art

Referring to FIG. 1, a first conventional nail gun includes a body 1, a vertical nail ejection member 2, and a horizontal nail magazine 4 for receiving a rectangular nail strip 5.

With reference to FIG. 2, a second conventional nail gun includes a body 1', a nail ejection member 2', and an inclined nail magazine 4' extending outwardly and upwardly from the nail ejection member 2' for receiving a parallelogram nail strip 5'.

To increase the flexibility to use in various working spaces, a pneumatic nail gun disclosed in U.S. Pat. No. 6,431,428 includes a body, a handle and an adjustable magazine. The handle is formed with an extension extending laterally therefrom. The extension is formed with a groove therethrough. A bolt is attached to the magazine, and is movable within the groove in the extension to thereby allow the magazine to rotate to a desired angle relative to the body. However, due to the presence of the extension, the space occupied by the pneumatic nail gun is increased.

SUMMARY OF THE INVENTION

The object of this invention is to provide a nail gun that includes an angle-adjustable nail magazine and that does not include an extension extending laterally from a handle.

According to this invention, a nail gun includes a body, a handle, a nail ejection member, a magazine member connected pivotally to the nail ejection member, and a connecting rod having an upper end connected pivotally to an end of the handle. One of the connecting rod and the magazine member is connectable with a selected one of first and second positioning portions of the other of the connecting rod and the magazine member to allow the magazine member to change between horizontal and inclined positions. In the horizontal position, a free end of the magazine member is spaced apart from the end of the handle. In the inclined position, the free end of the magazine member is adjacent to the end of the handle, and the connecting rod abuts against the magazine member along a full length thereof to thereby reduce significantly the space occupied by the nail gun.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
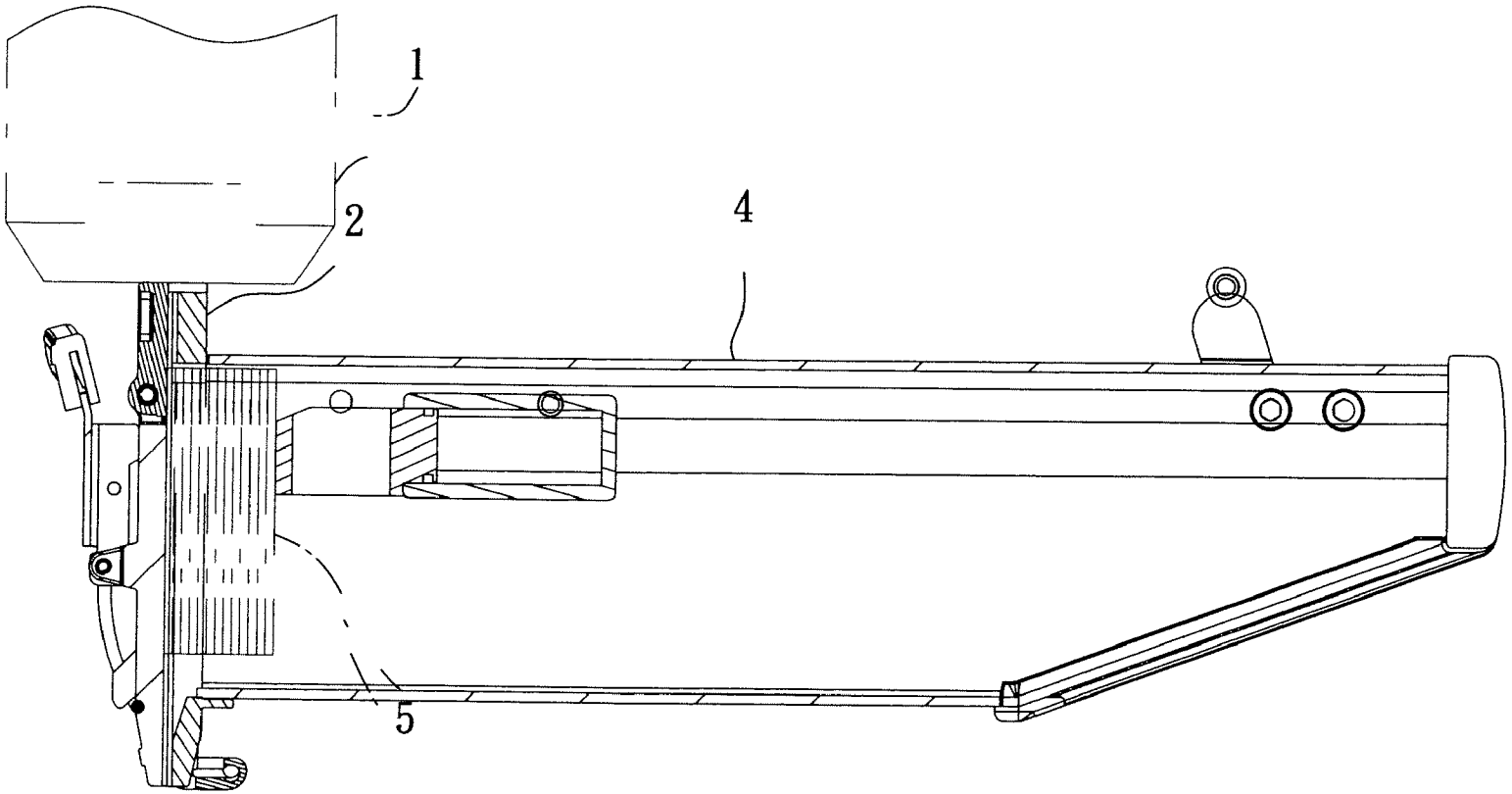
FIG. 1 PRIOR ART
FIG. 1 is a fragmentary side view of a first conventional nail gun.
Figure 2:
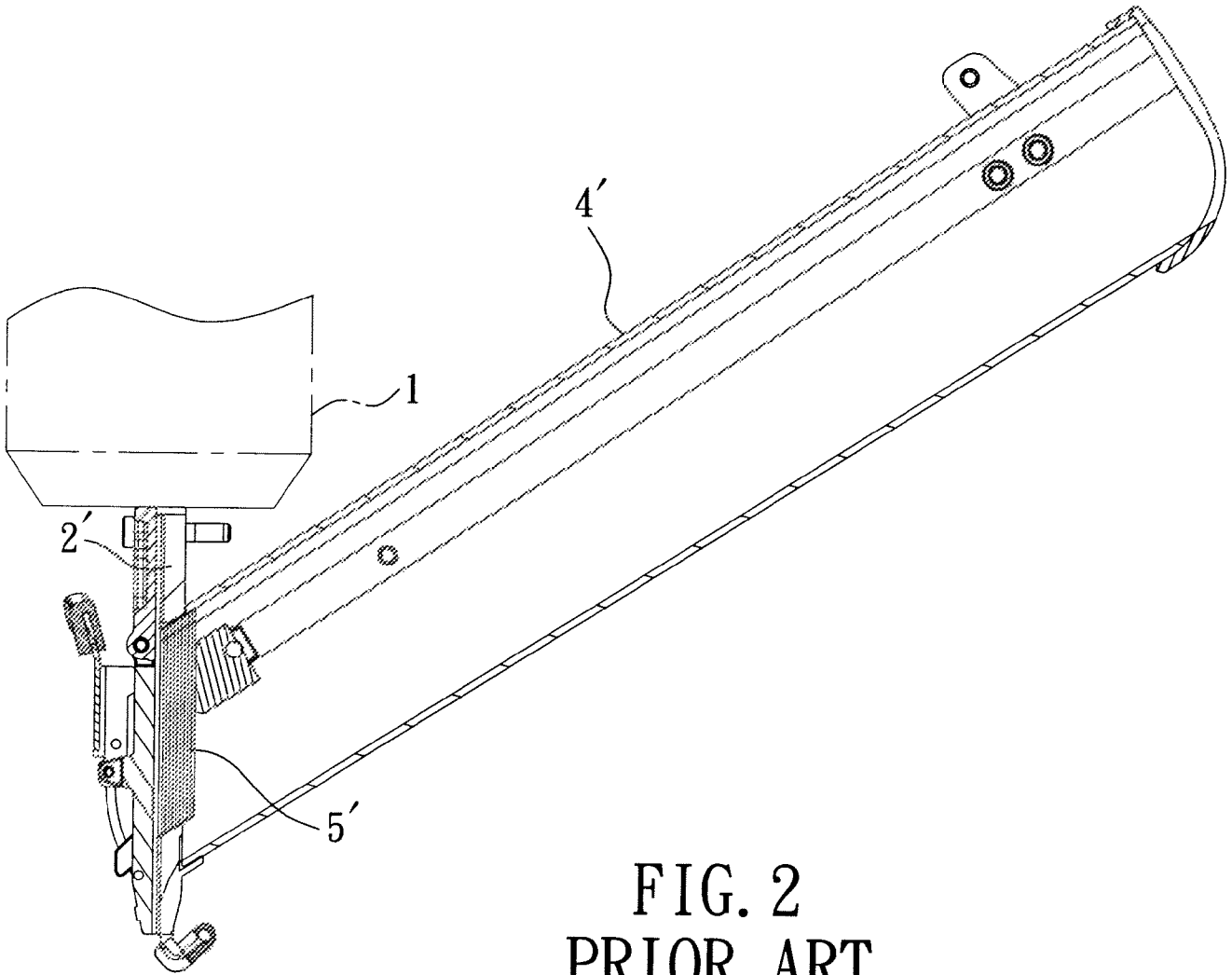
FIG. 2 PRIOR ART
FIG. 2 is a fragmentary side view of a second conventional nail gun.

In the following description, directional terms including "vertical", "upper", "lower", and other similar terms will be used to refer to the nail gun in a convenient orientation, in which the nail gun is shown in the drawings. It should be understood that this invention is not limited to any particular orientation.

Before the present invention is described in greater detail in connection with the preferred embodiments, it should be noted that similar elements and structures are designated by like reference numerals throughout the entire disclosure.

Figure 3:
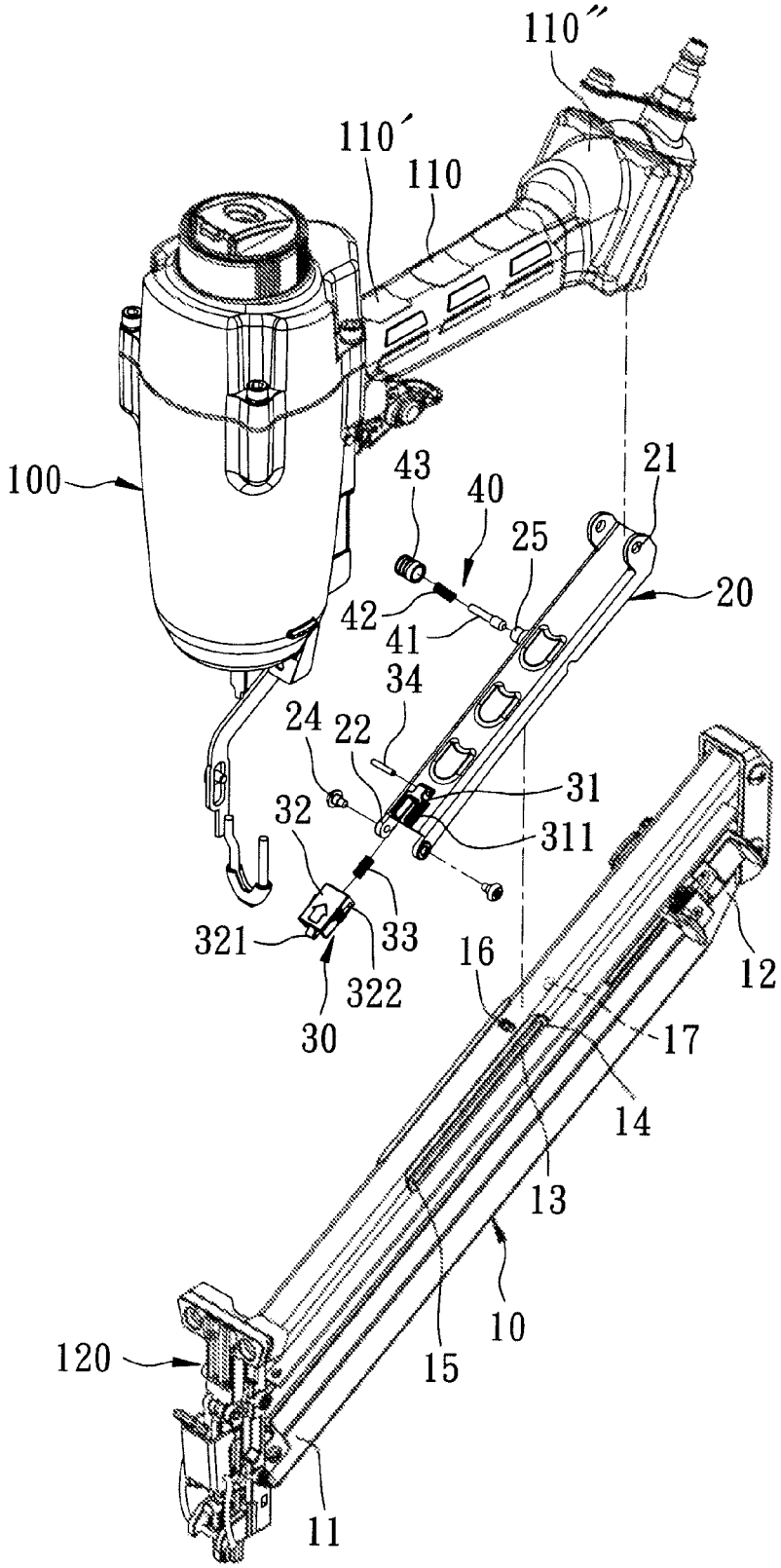
FIG. 3 is a partly exploded perspective view of the first preferred embodiment of a nail gun according to this invention.
Figure 4:
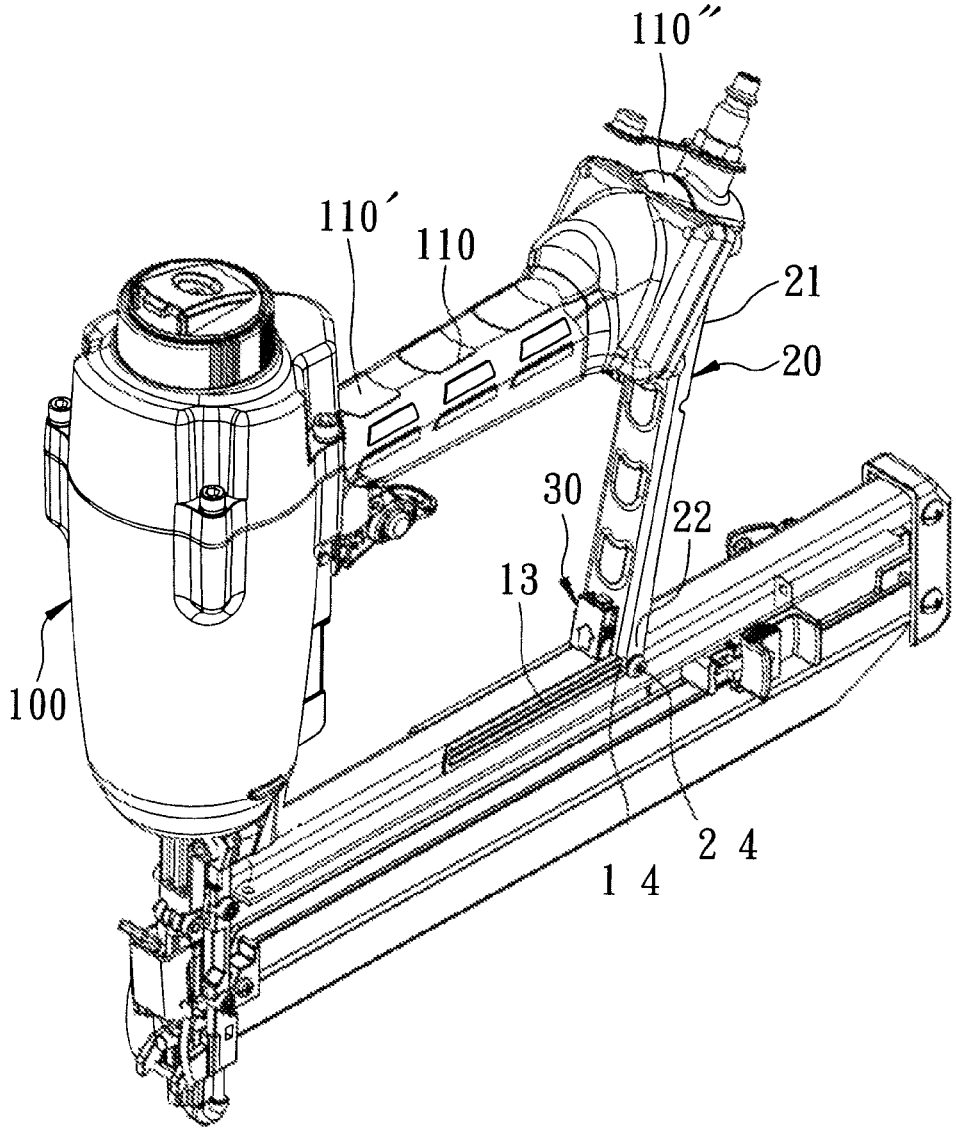
FIG. 4 is an assembled perspective view of the first preferred embodiment.

Referring to FIGS. 3 and 4, the first preferred embodiment of a nail gun according to this invention includes a body 100, a handle 110 connected fixedly to and extending laterally from the body 100, a nail ejection member 120 connected to and disposed under the body 100 and extending along a vertical direction, and a nail magazine unit. The nail magazine unit includes a magazine member 10, a connecting rod 20, a first positioning unit 30, and a second positioning unit 40.

The handle 110 has a proximate end 110' connected to the body 100, and a distal end 110" opposite to the proximate end 110'.

The magazine member 10 has a proximate end 11 connected pivotally to the nail ejection member 120, and a distal end (i.e. free end) 12 opposite to the proximate end 11. The magazine member 10 further has a guide slot 13 extending along a longitudinal direction thereof. The guide slot 13 has opposite first and second ends 14, 15 constituting respectively first and second positioning portions. The first end 14 is proximate to the distal end 12 of the magazine member 10. The second end 15 is distal from the distal end 12 of the magazine member 10.

Figure 5:
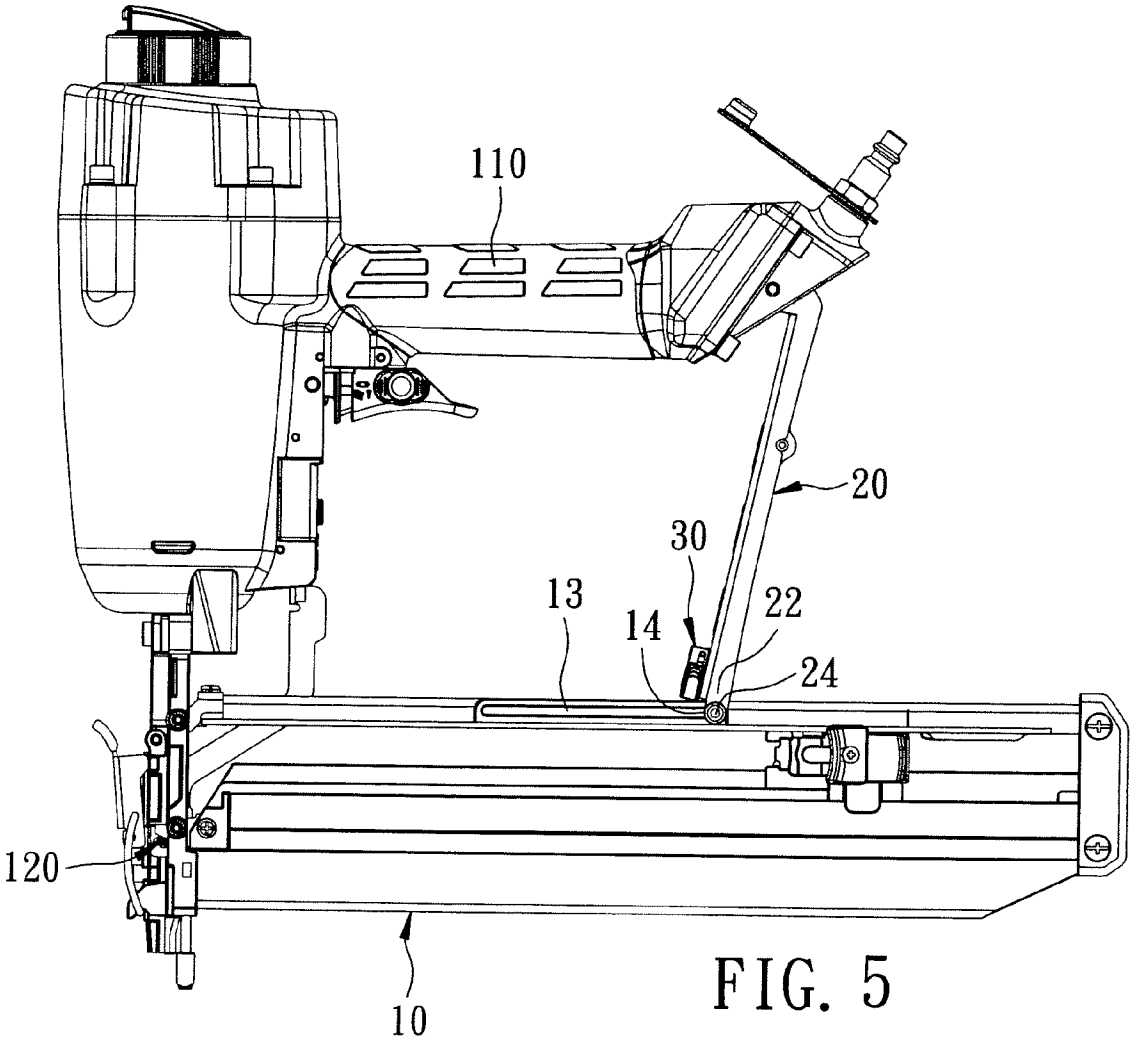
FIG. 5 is a side view of the first preferred embodiment when a connecting rod is connected to a first positioning portion of a magazine member such that the magazine member is perpendicular to a nail ejection member.

The connecting rod 20 has an upper end 21 connected pivotally to the distal end 110" of the handle 110, and a lower end 22. In this embodiment, the connecting rod 20 has an inverted U-shaped cross-section, and defines a groove 23 (see FIG. 7) in a bottom surface thereof. The lower end 22 of the connecting rod 20 is formed with an integral sliding member 24 movable within the guide slot 13 in the magazine member 10 between a horizontal position shown in FIGS. 4 and 5, and an inclined position shown in FIG. 8. In the horizontal position, the sliding member 24 is disposed in the first end 14 of the guide slot 13 (i.e., the lower end 22 of the connecting rod 20 is connected to the first positioning portion of the magazine member 10), and the magazine member 10 is perpendicular to the nail ejection member 120 so that the distal end 12 of the magazine member 10 is spaced apart from the distal end 110" of the handle 110. In the inclined position, the sliding member 24 of the connecting rod 20 is disposed in the second end 15 of the guide slot 13 (i.e., the lower end 22 of the connecting rod 20 is connected to the second positioning portion of the magazine member 10), and the distal end 12 of the magazine member 10 abuts against the distal end 110" of the handle 110. Also in the second position, the connecting rod 20 abuts against the magazine member 10 along the full length thereof such that a top side edge of the magazine member 10 is inserted into the groove 23 (see FIG. 7) in the connecting rod 20 so that the magazine member 10 is inclined relative to the nail ejection member 120, as shown in FIG. 8. As such, the space occupied by the nail gun is reduced significantly.

Figure 6:
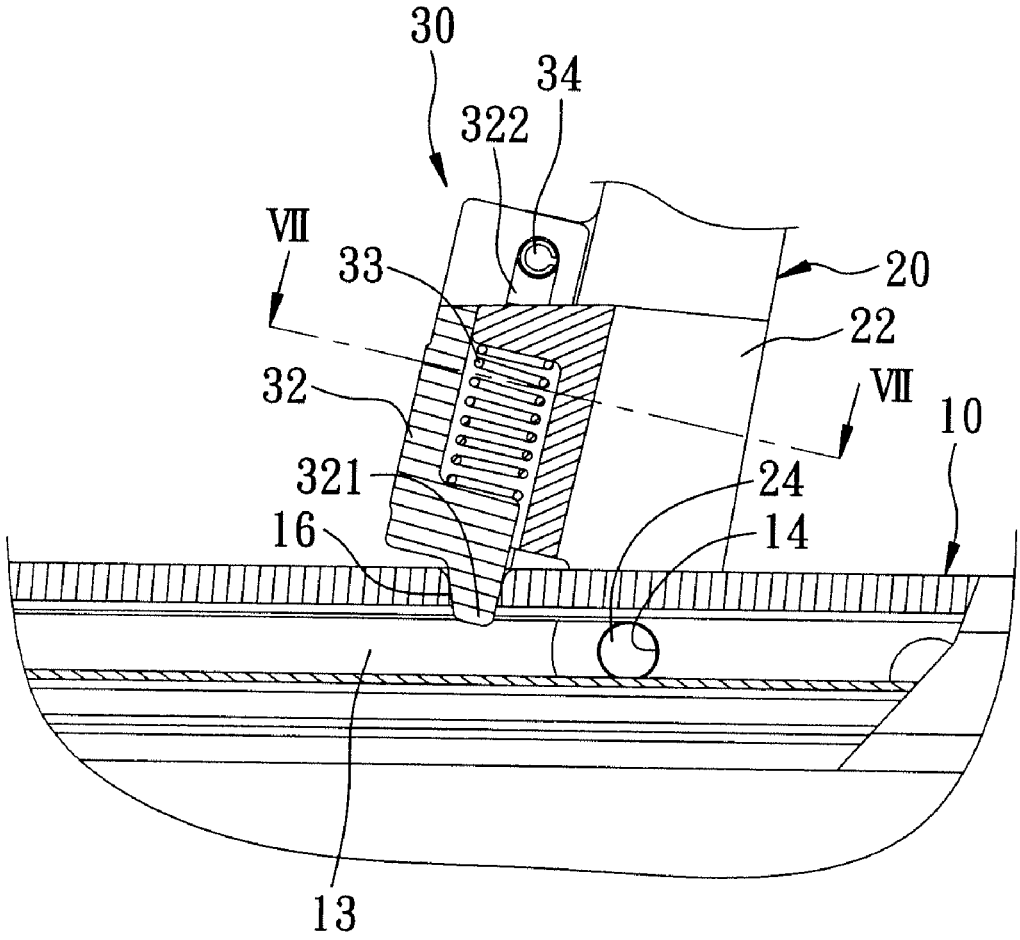
FIG. 6 is a fragmentary, partly sectional view of the first preferred embodiment, illustrating a first positioning unit.
Figure 7:
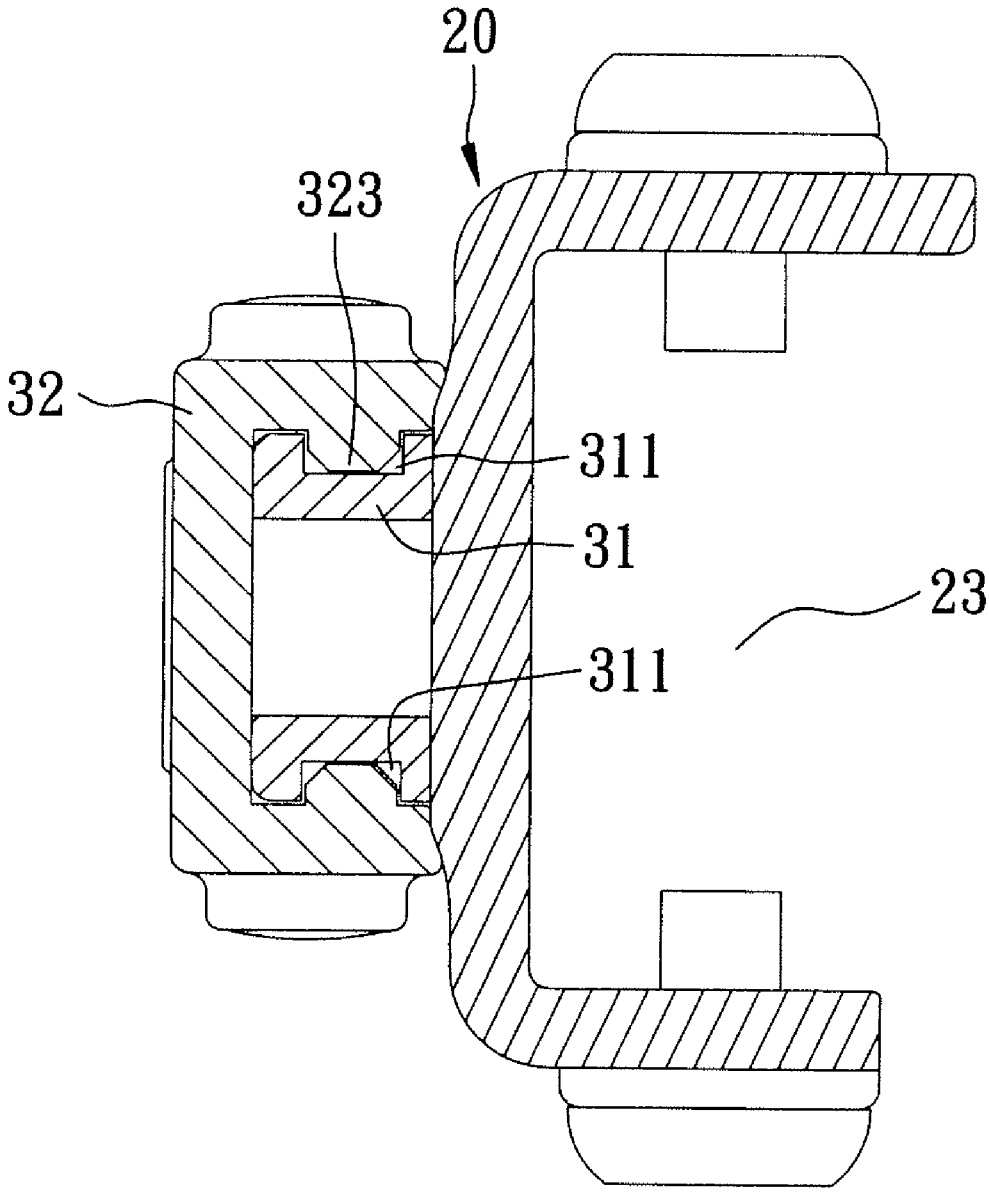
FIG. 7 is a sectional view taken along Line VII-VII in FIG. 6.
Figure 8:
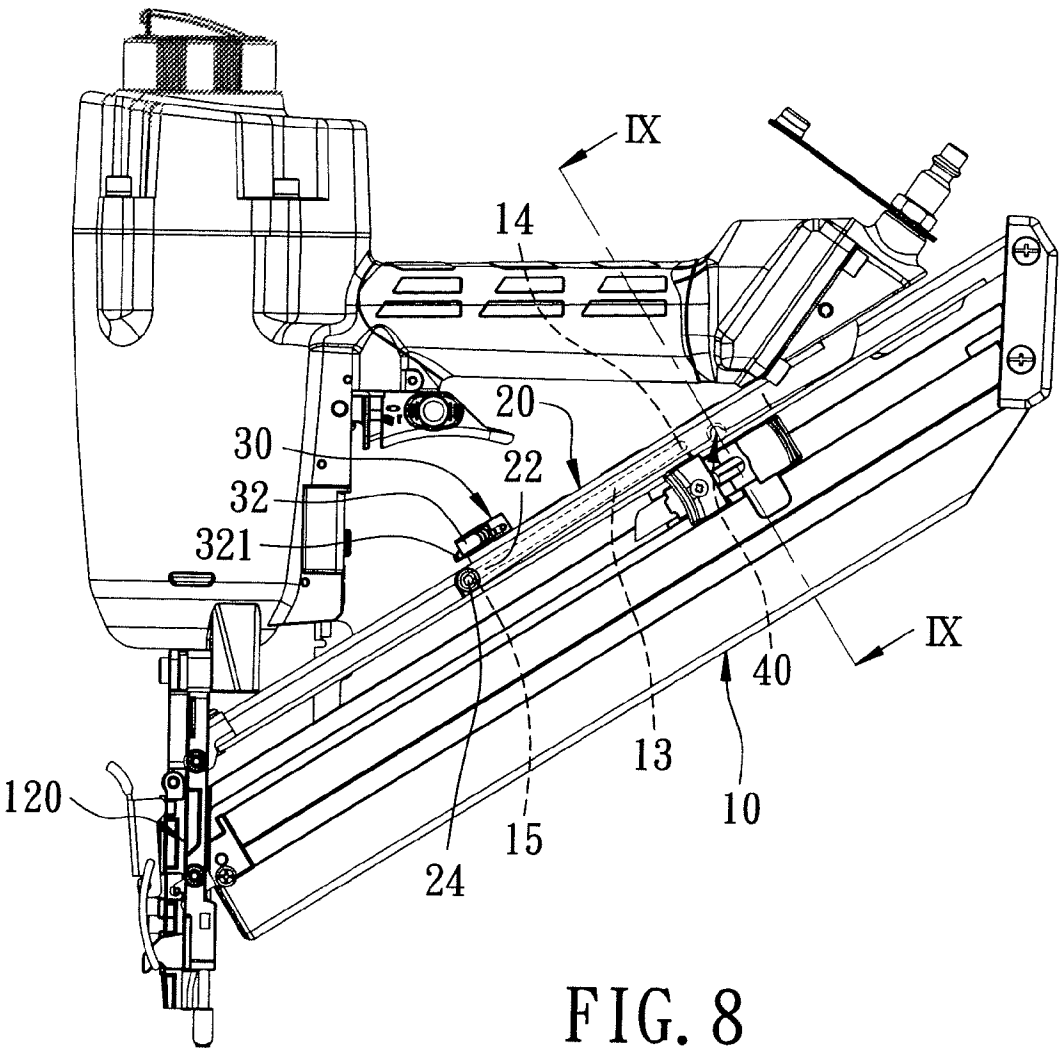
FIG. 8 is a view similar to FIG. 5 but illustrating the connecting rod connected to a second positioning portion of the magazine member.

With further reference to FIGS. 6 and 7, the magazine member 10 further has a top surface formed with a top positioning groove 16 disposed directly above the guide slot 13 and adjacent to the first end 14 of the guide slot 13. The first positioning unit 30 includes a mounting seat 31 disposed fixedly on the lower end 22 of the connecting rod 20, a lower positioning member 32 disposed movably on the mounting seat 31, and a first resilient member 33 for biasing an engaging projection 121 of the lower positioning member 32 to move in a longitudinal direction of the connecting rod 20 to engage the top positioning groove 16 in the magazine member 10 when the sliding member 24 is disposed in the first end 14 of the guide slot 13, thereby maintaining the sliding member 24 in the first end 14 of the guide slot 13. The first resilient member 33 is configured as a coiled compression spring, and is disposed between the mounting seat 31 and the lower positioning member 32.

The lower positioning member 32 is operable to remove from the top positioning groove 16 against the biasing action of the resilient member 33 to allow the sliding member 24 to move within the guide slot 13.

In this embodiment, the mounting seat 31 has two opposite side walls formed with aligned slide slots 311. The lower positioning member 32 is formed with a limiting slot 322 parallel to the slide slots 311, and two aligned sliding ribs 323 engaging respectively and movably the slide slots 311. The first positioning unit 30 further includes a limiting pin 34 extending through the mounting seat 31 and the limiting slot 322 in the lower positioning member 32 for preventing removal of the lower positioning member 32 from the mounting seat 31.

Figure 9:
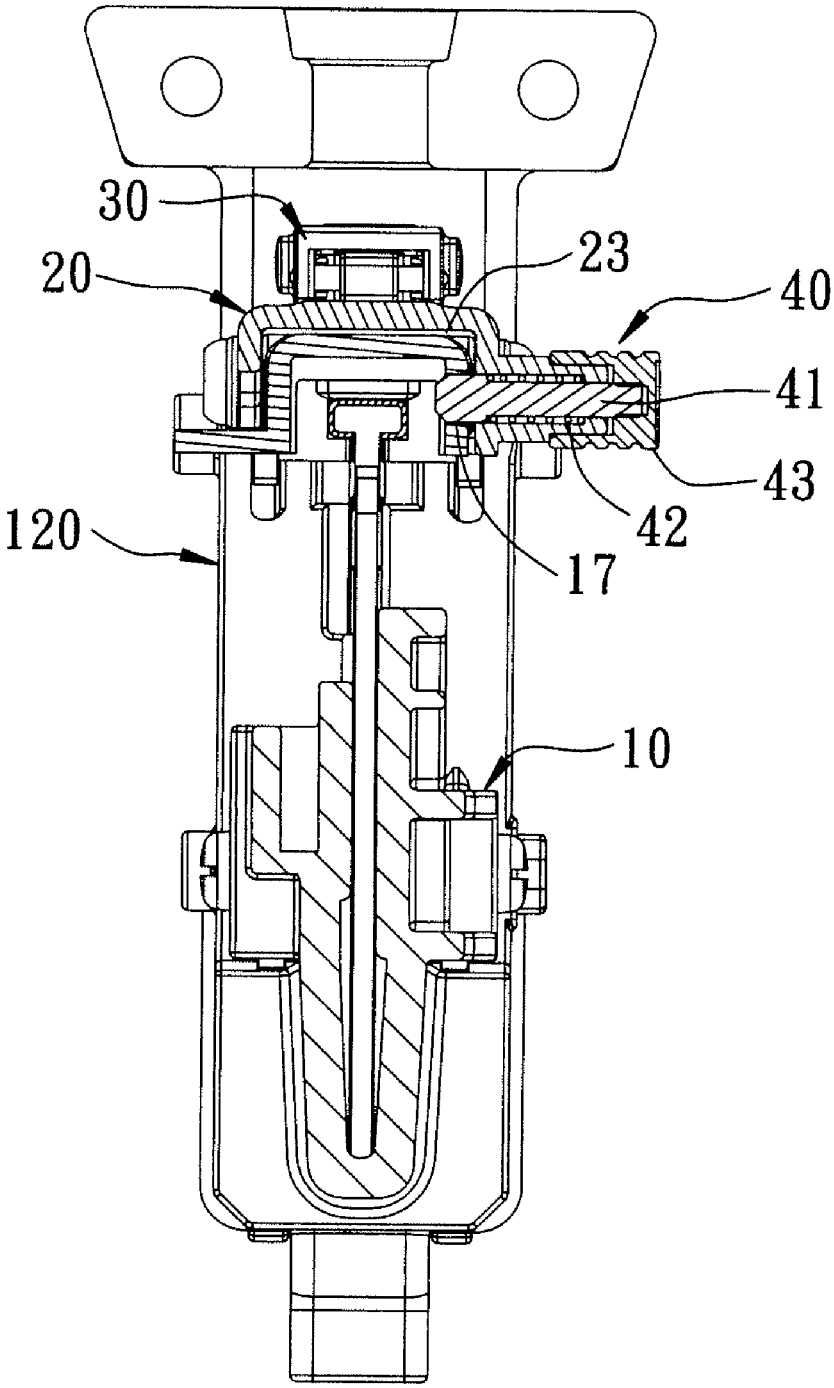
FIG. 9 is a sectional view taken along Line IX-IX in FIG. 8, illustrating a second positioning unit.

With further reference to FIGS. 8 and 9, the magazine member 10 further has a lateral side surface formed with a side positioning groove 17 that is disposed between the guide slot 13 and the distal end 12 and that is adjacent to the first end 14 of the guide slot 13. The connecting rod 20 further includes an integral projecting tube 25 disposed between the upper and lower ends 21, 22. The second positioning unit 40 includes an upper positioning member 41 configured as a pin, a second resilient member 42, and an operating member 43. The upper positioning member 41 is disposed movably within the projecting tube 25 of the connecting rod 20. The operating member 23 is sleeved movably on an end of the projecting tube 25. The upper positioning member 41 has a threaded end that is threaded within the operating member 43. The second resilient member 42 is disposed in the projecting tube 25 for biasing the upper positioning member 41 to move in a transverse direction of the connecting rod 20 to engage the side positioning groove 17 in the magazine member 10 when the sliding member 24 is disposed in the second end 15 of the guide slot 13, thereby maintaining the sliding member 24 in the second end 15 of the guide slot 13. The operating member 43 is operable to remove the upper positioning member 41 from the side positioning groove 17 in the magazine member 10 against the biasing action of the second resilient member 42.

Figure 10:
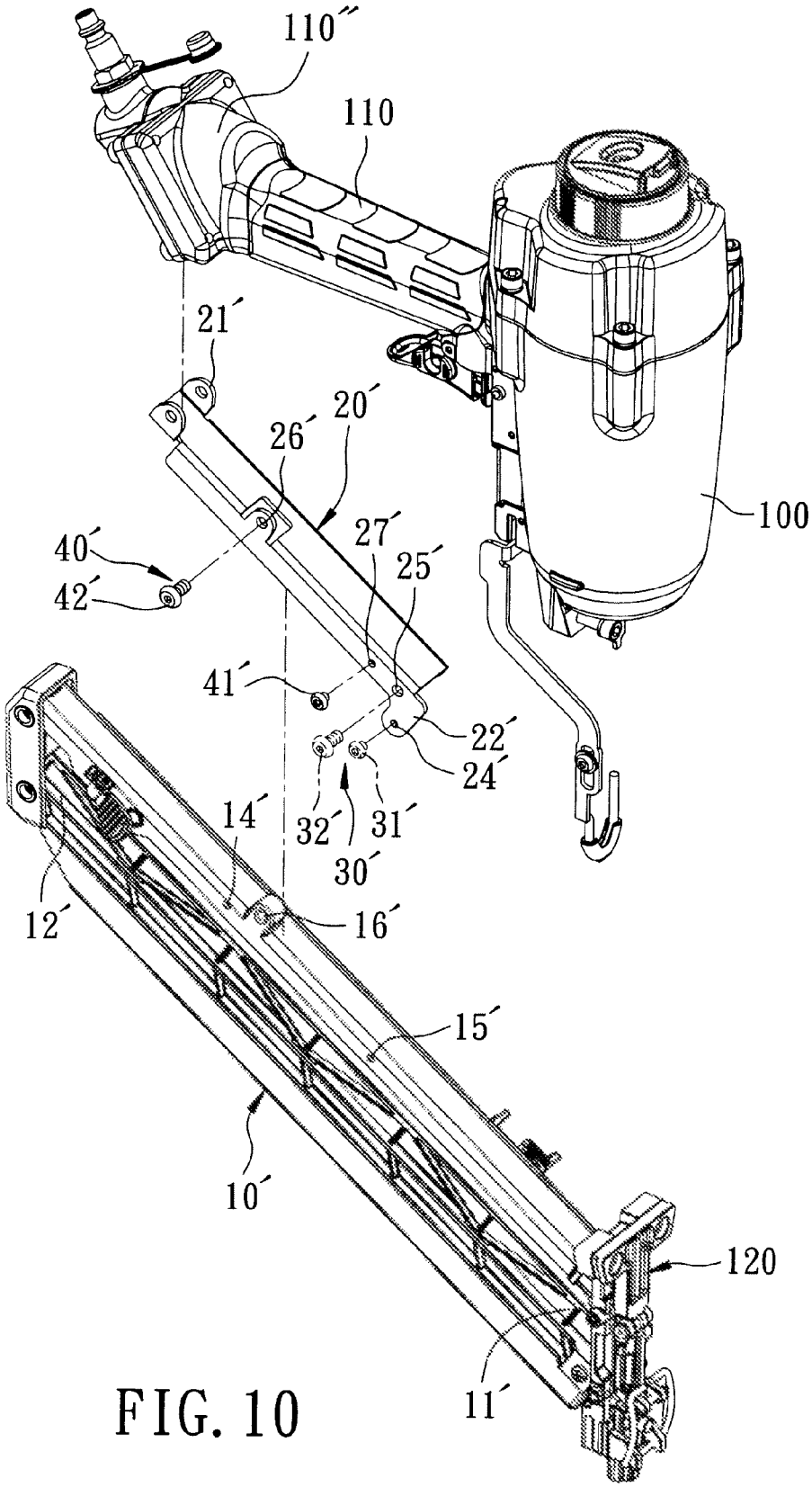
FIG. 10 is a partly exploded perspective view of the second preferred embodiment of a nail gun according to this invention.

With reference to FIG. 10, the second preferred embodiment of a nail gun according to this invention includes a body 100, a handle 110, a nail ejection member 120, and a nail magazine unit consisting of a magazine member 10', a connecting rod 20', a first connecting unit 30', and a second connecting unit 40'. The body 100, the handle 110, and the nail ejection member 120 of this embodiment are similar in construction to the first preferred embodiment.

Unlike the first preferred embodiment, each of the first and second positioning portions 14', 15' of the magazine member 10' is configured as a threaded hole. The magazine member 10' further has an engaging hole 16' disposed between the first and second positioning portions 14', 15'.

The connecting rod 20' has an upper end 21' connected pivotally to the distal end 110" of the handle 110, a lower end 22', a pair of first and second positioning holes 24', 25' formed in the lower end 22', and a pair of third and fourth positioning holes 26', 27' disposed between the upper end 21' and an assembly of the first and second positioning holes 24', 25'.

Figure 11:
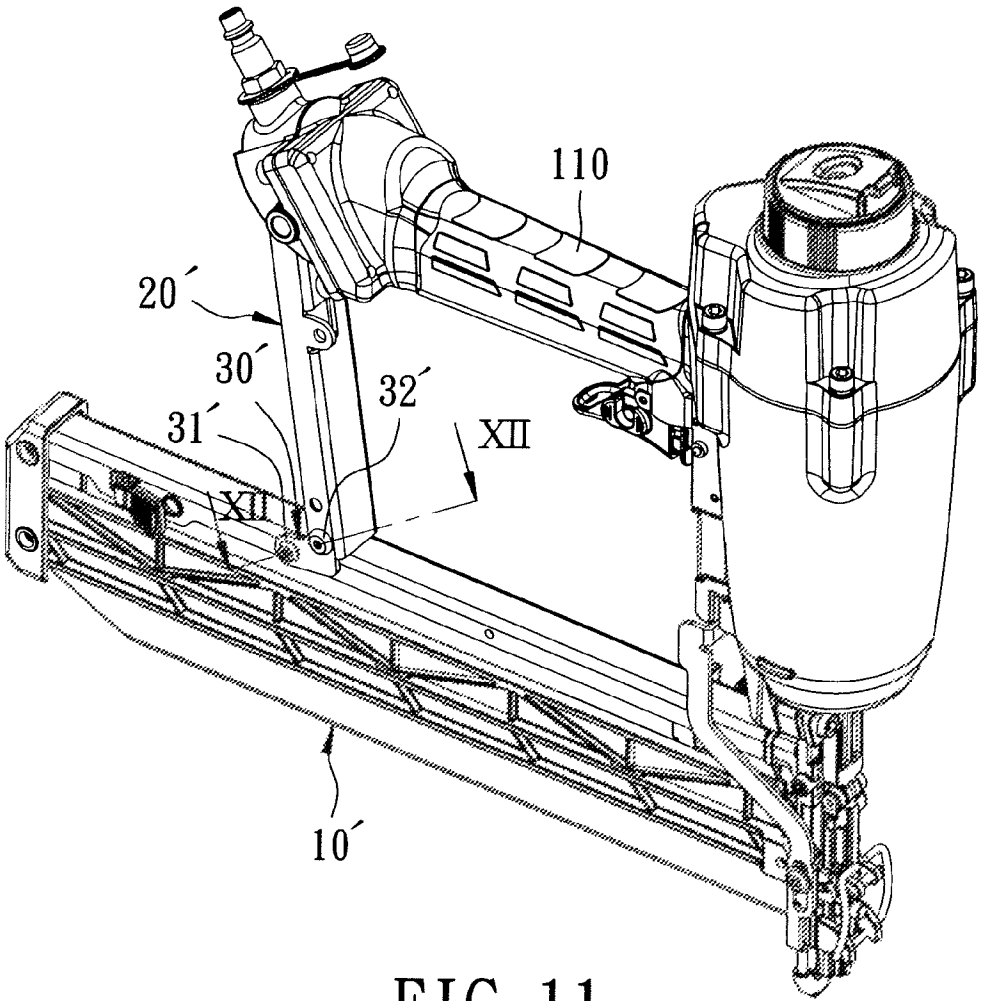
FIG. 11 is an assembled perspective view of the second preferred embodiment when a connecting rod is connected to a first positioning portion of a magazine member such that the magazine member is perpendicular to a nail ejection member.
Figure 12:
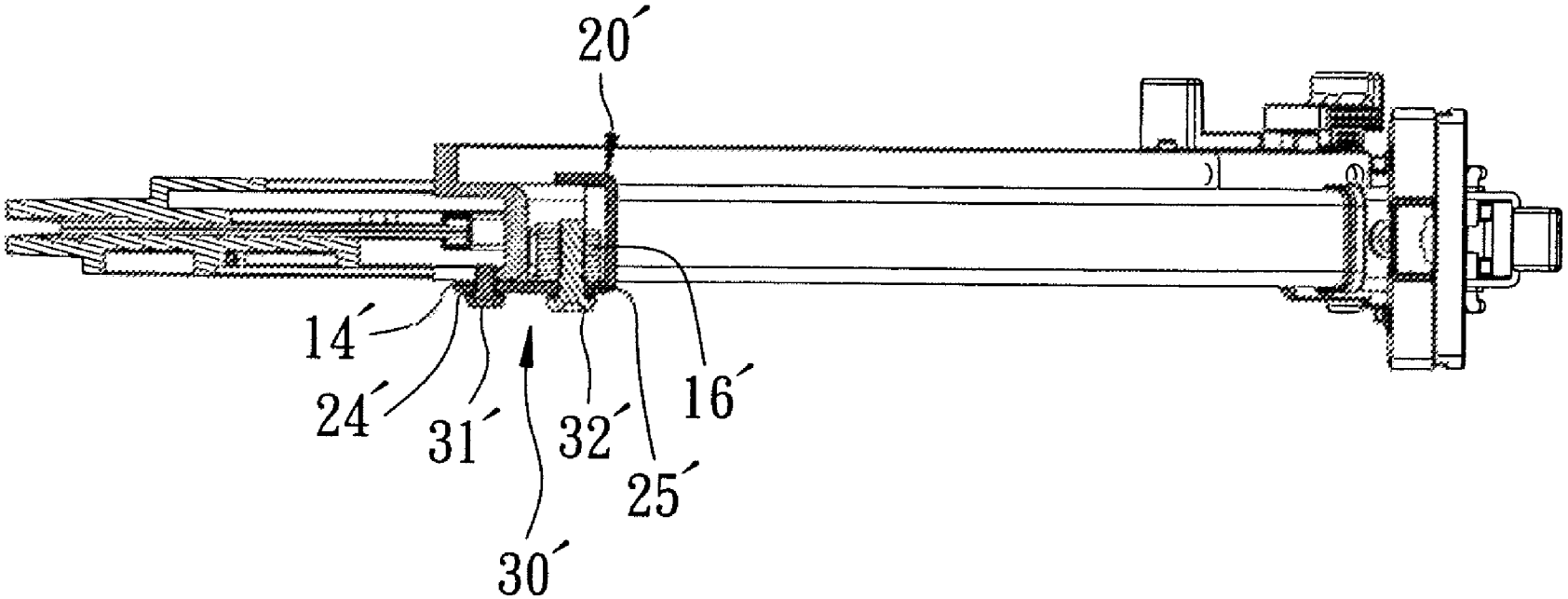
FIG. 12 is a sectional view taken along Line XII-XII in FIG. 11.

With further reference to FIGS. 11 and 12, the first connecting unit 30' connects the connecting rod 20' to the first positioning portion 14' of the magazine member 10', and includes two first lock bolts 31', 32'. One first lock bolt 31' extends through the first positioning hole 24' in the connecting rod 20' to engage the first positioning portion 14' of the magazine member 10'. The other first lock bolt 32' extends through the second positioning holes 25' in the connecting rod 20' to engage the engaging hole 16' in the magazine member 10'.

Figure 13:
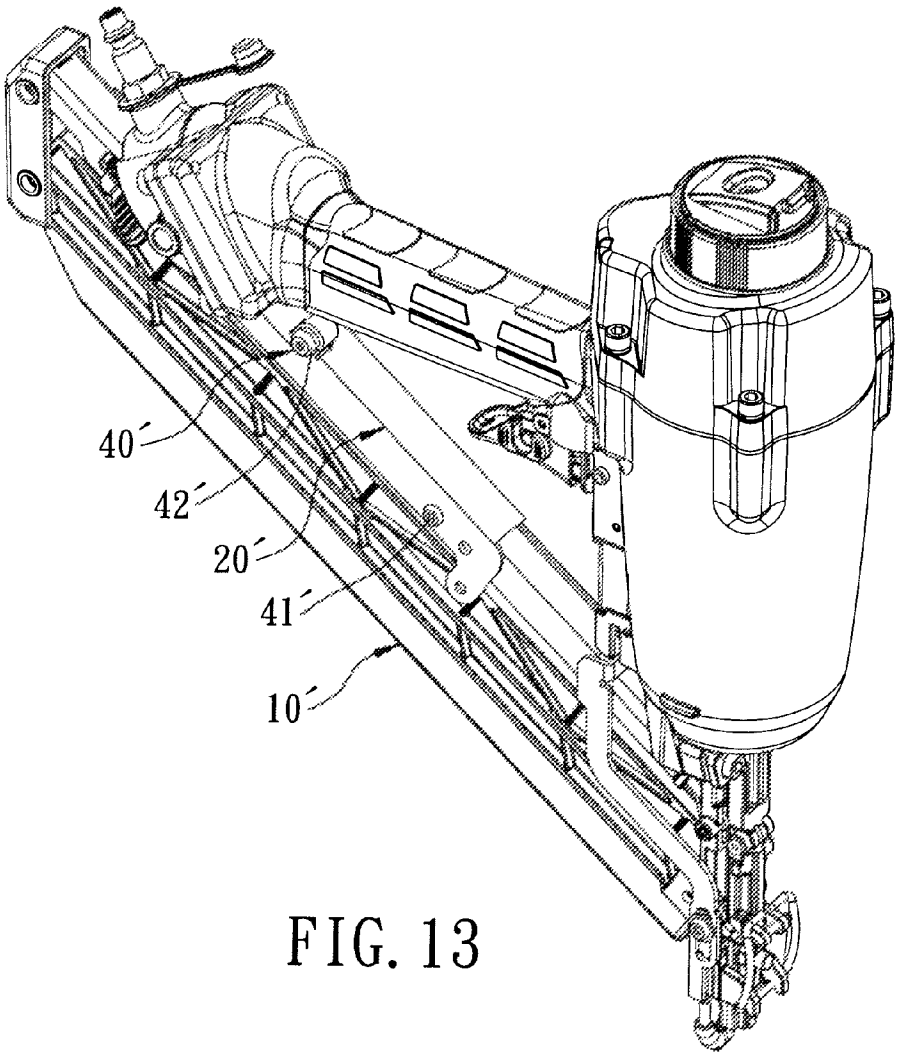
FIG. 13 is a view similar to FIG. 11 but illustrating the connecting rod connected to a second positioning portion of the magazine member.
Figure 14:
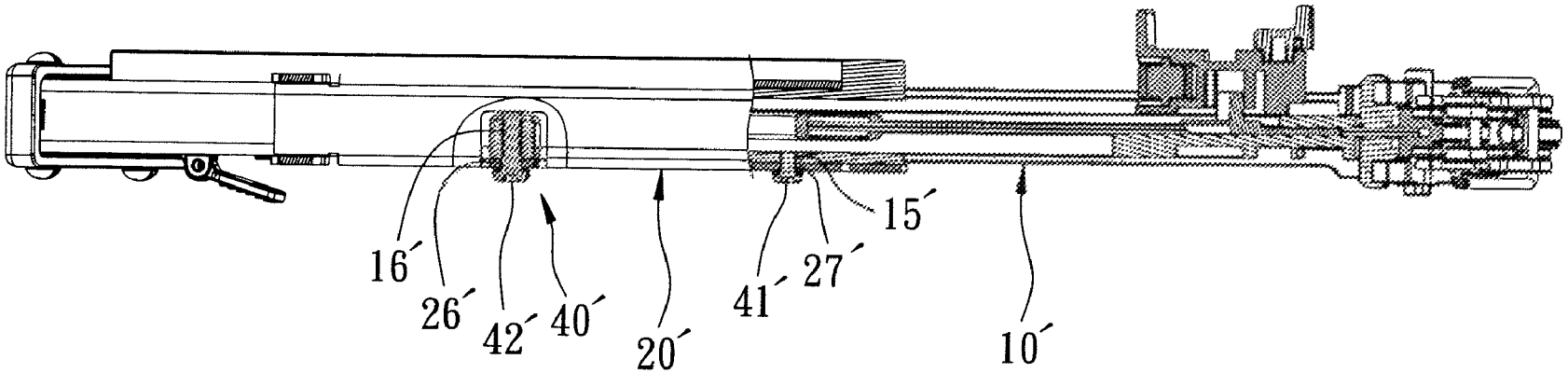
FIG. 14 is a schematic, partly sectional top view of the second preferred embodiment when the connecting rod is connected to the second positioning portion of the magazine member.

With further reference to FIGS. 13 and 14, the second connecting unit 40' connects the connecting rod 20' to the second positioning portion 15' of the magazine member 10', and includes two second lock bolts 41', 42'. One second lock bolt 41' extends through the fourth positioning hole 27' in the connecting rod 20' to engage the second positioning portion 15' of the magazine member 10'. The other second lock bolt 42' extends through the third positioning hole 26' in the connecting rod 20' to engage the engaging hole 16' in the magazine member 10'. The first lock bolt 31' and the second lock bolt 41' may be the same bolt. The first lock bolt 32' and the second lock bolt 42' may be the same bolt.

Figure 15:
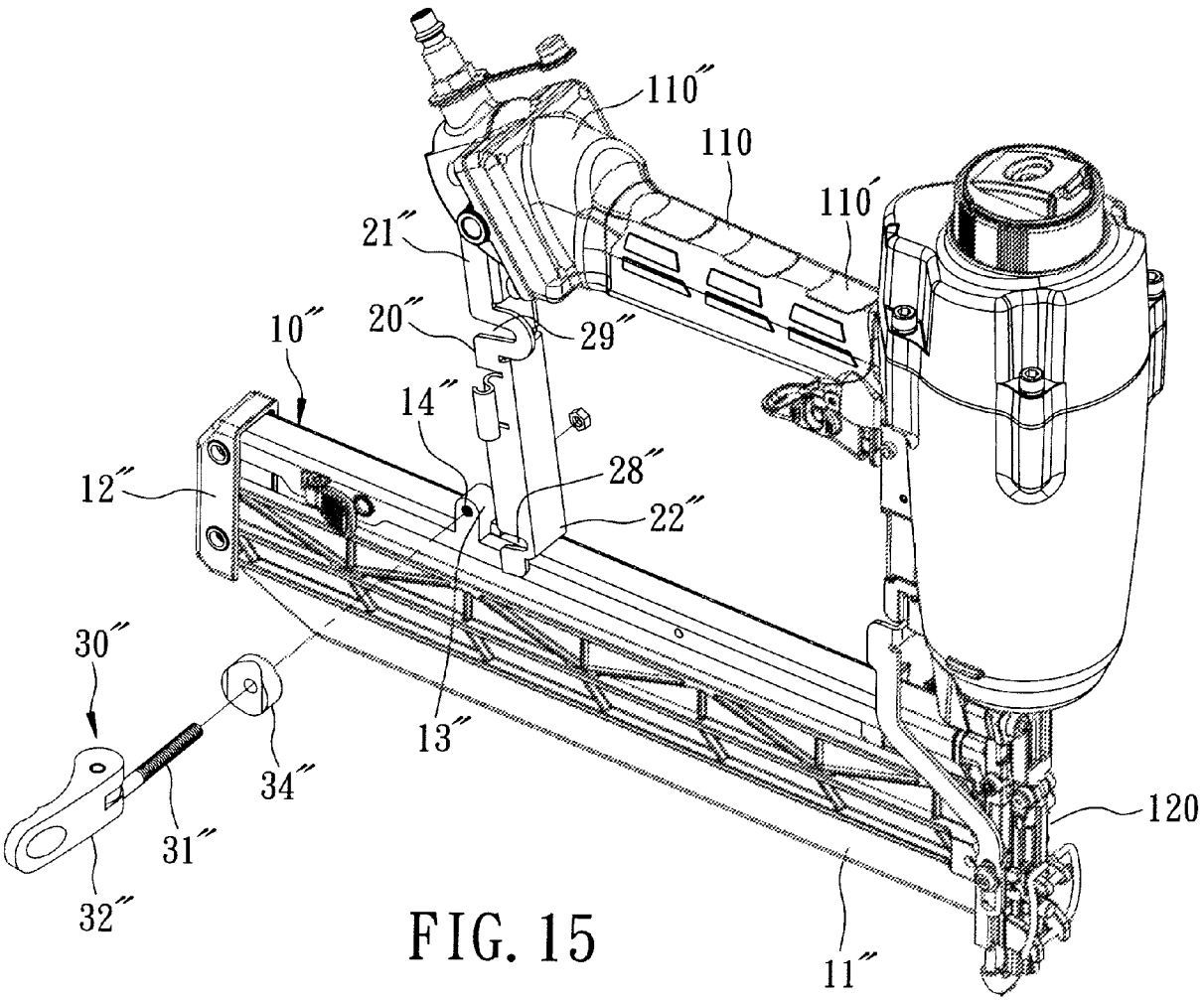
FIG. 15 is a perspective view of the third preferred embodiment of a nail gun according to this invention when a magazine member is connected to a first positioning portion of a connecting rod.
Figure 16:
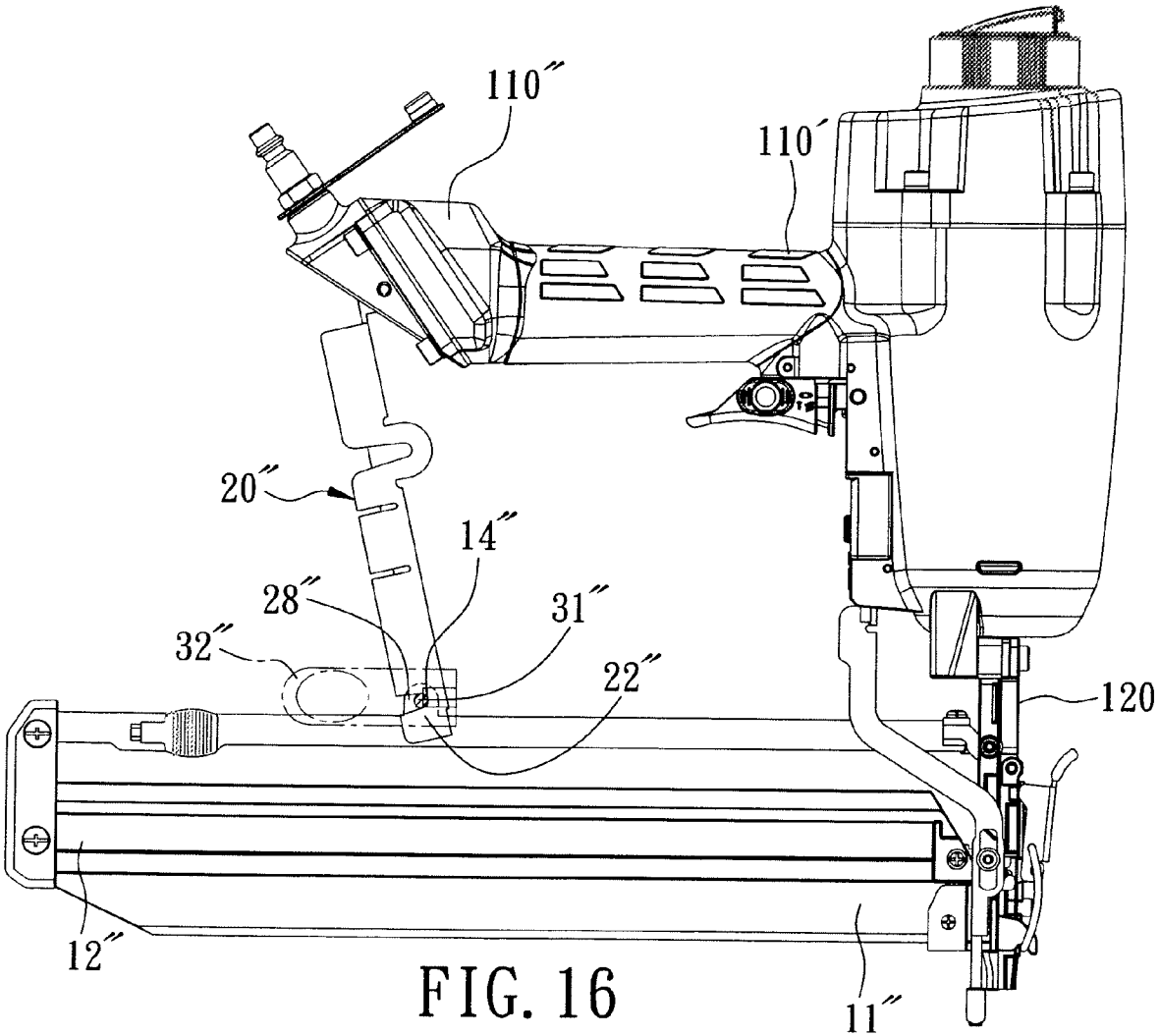
FIG. 16 is a side view of the third preferred embodiment when the magazine member is connected to the first positioning portion of the connecting rod.
Figure 17:
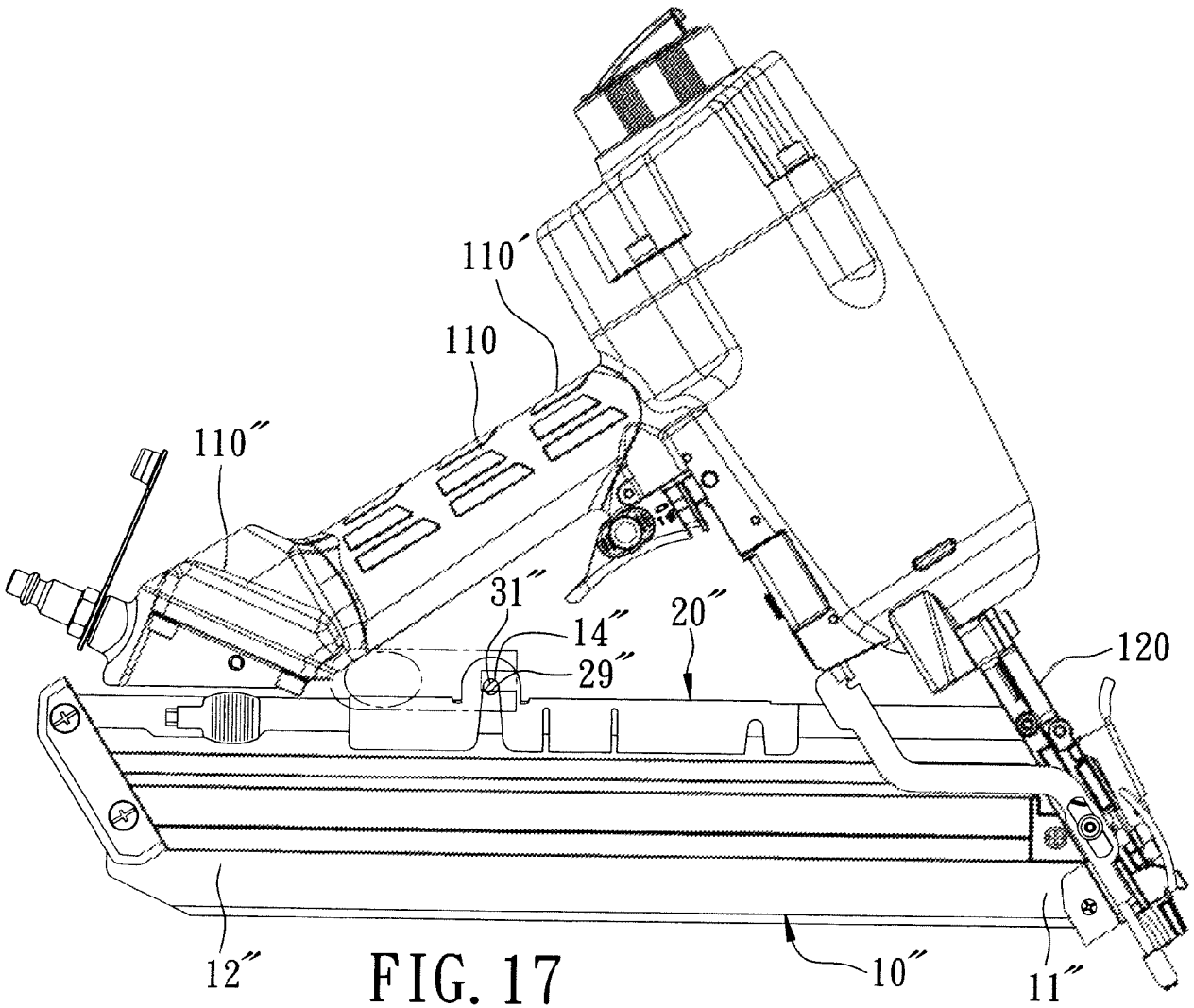
FIG. 17 is a side view of the third preferred embodiment when the magazine member is connected to a second positioning portion of the connecting rod.

FIG. 15 shows the third preferred embodiment of a nail gun according to this invention that includes a modified nail magazine unit. The modified nail magazine unit includes a magazine member 10", a connecting rod 20", and a quick release latch 30". The connecting rod 20" has an upper end 21", a lower end 22", a first positioning portion configured as a first positioning groove 28" formed in the lower end 22", and a second positioning portion configured as a second positioning groove 29" disposed between the upper and lower ends 21", 22". The magazine member 10" has a proximate end 11" connected pivotally to the nail ejection member 120, a distal end 12", and a projection 13" formed on a top surface thereof. The quick release latch 30" includes a threaded rod portion 31" and a cam lever 32" connected pivotally to an end of the threaded rod portion 31". The threaded rod portion 31" engages a threaded hole 14" in the projection 13" of the magazine member 10". When the cam lever 32" is operated to engage the threaded rod portion 31" with the first positioning groove 28", the magazine member 10" is disposed in a horizontal position shown in FIG. 16. In the horizontal position, the magazine member 10" is perpendicular to the nail ejection member 120, and the distal end 12" of the magazine member 10" is spaced apart from the distal end 110" of the handle 110. When the cam lever 32" is operated to engage the threaded rod portion 31" with the second positioning groove 29", the magazine member 10" is disposed in an inclined position shown in FIG. 17. In the inclined position, the distal end 12" of the magazine member 10" abuts against the distal end 110" of the handle 110, and the connecting rod 20" abuts against the magazine member 10" along a full length thereof.

With this invention thus explained, it is apparent that numerous modifications and variations can be made without departing from the scope and spirit of this invention. It is therefore intended that this invention be limited only as indicated by the appended claims.

I claim:

1. A nail gun comprising:

a body;

a handle having a proximate end connected fixedly to and extending laterally from said body, and a distal end opposite to said proximate end of said handle;

a nail ejection member connected to and disposed under said body and extending along a vertical direction; and a magazine member having a proximate end connected pivotally to said nail ejection member, a distal end opposite to said proximate end of said magazine member, a first positioning portion proximate to said distal end of said magazine member, and a second positioning portion disposed between said first positioning portion and said proximate end of said magazine member, said first and second positioning portions of said magazine member being spaced apart from each other along a longitudinal direction of said magazine member; and a connecting rod having an upper end connected pivotally to said distal end of said handle;

wherein said connecting rod is connectable with both of said first and second positioning portions, such that said connecting rod can be connected to either said first or second positioning portion of said magazine member to allow for an adjustment of said magazine member relative to said nail ejection member between two positions.

2. The nail gun as claimed in claim 1, wherein said first and second positioning portions of said magazine member are positioned such that, when said connecting rod is connected to said first positioning portion, said magazine member is perpendicular to said nail ejection member, and said distal end of said magazine member is spaced apart from said distal end of said handle, and when said connecting rod is connected to said second positioning portion, said connecting rod abuts against said magazine member along a full length thereof, and said distal end of said magazine member is adjacent to said distal end of said handle.

3. The nail gun as claimed in claim 2, wherein said connecting rod has an inverted U-shaped cross-section, and defines a groove in a bottom surface thereof, and said magazine member has a top side edge that is inserted into said groove in said connecting rod when said connecting rod is connected to said second positioning portion.

4. The nail gun as claimed in claim 2, wherein:

said magazine member is formed with a guide slot extending along a longitudinal direction thereof, said guide slot having opposite first and second ends constituting respectively said first and second positioning portions; and said connecting rod has a lower end formed with an integral sliding member movable within said guide slot in said magazine member.

5. The nail gun as claimed in claim 4, further comprising a positioning unit for locking said magazine member relative to said handle when said sliding member of said connecting rod is disposed in said first end of said guide slot in said magazine member.

6. The nail gun as claimed in claim 5, wherein said magazine member has a top surface formed with a top positioning groove, said positioning unit including a spring-biased lower positioning member disposed at said lower end of said connecting rod and biased to move in a longitudinal direction of said connecting rod to engage said top positioning groove in said magazine member when said sliding member of said connecting rod is disposed in said first end of said guide slot, said lower positioning member being operable to be removed from said top positioning groove in said magazine member to allow said sliding member of said connecting rod to move within said guide slot in said magazine member.

7. The nail gun as claimed in claim 6, wherein said positioning unit further includes a mounting seat disposed fixedly on said lower end of said connecting rod and having two opposite side walls formed with aligned slide slots, said lower positioning member being formed with two aligned sliding ribs engaging respectively and movably said slide slots in said mounting seat.

8. The nail gun as claimed in claim 4, further comprising a positioning unit for locking said magazine member relative to said handle when said sliding member of said connecting rod is disposed in said second end of said guide slot in said magazine member.

9. The nail gun as claimed in claim 8, wherein said magazine member has a lateral side surface formed with a side positioning groove, said second positioning unit including a spring-biased upper positioning member disposed between said upper and lower ends of said connecting rod and biased to move in a transverse direction of said connecting rod to engage said side positioning groove in said magazine member when said sliding member of said connecting rod is disposed in said second end of said guide slot, said upper positioning member being operable to remove from said side positioning groove in said magazine member to allow said sliding member of said connecting rod to move within said guide slot in said magazine member.

10. The nail gun as claimed in claim 4, further comprising:

a first positioning unit for locking said magazine member relative to said handle when said sliding member of said connecting rod is disposed in said first end of said guide slot in said magazine member; and a second positioning unit for locking said magazine member relative to said handle when said sliding member of said connecting rod is disposed in said second end of said guide slot in said magazine member.

11. The nail gun as claimed in claim 10, wherein:

said magazine member has a top surface formed with a top positioning groove, and a lateral side surface formed with a side positioning groove;

said first positioning unit includes a spring-biased lower positioning member disposed at said lower end of said connecting rod and biased to move in a longitudinal direction of said connecting rod to engage said top positioning groove in said magazine member when said sliding member of said connecting rod is disposed in said first end of said guide slot, said lower positioning member being operable to remove from said top positioning groove in said magazine member to allow said sliding member of said connecting rod to move within said guide slot in said magazine member; and said second positioning unit includes a spring-biased upper positioning member disposed between said upper and lower ends of said connecting rod and biased to move in a transverse direction of said connecting rod to engage said side positioning groove in said magazine member when said sliding member of said connecting rod is disposed in said second end of said guide slot, said upper positioning member being operable to remove from said side positioning groove in said magazine member to allow said sliding member of said connecting rod to move within said guide slot in said magazine member.

12. The nail gun as claimed in claim 11, wherein:

said first positioning portion of said magazine member is configured as a threaded hole;

said magazine member further has an engaging hole; and a pair of first and second positioning holes are formed in said lower end of said connecting rod; and said nail gun further comprises a first connecting unit for connecting said connecting rod to said first positioning portion of said magazine member, said first connecting unit including two first lock bolts, one of said first lock bolts extending through said first positioning hole in said connecting rod to engage said first positioning portion of said magazine member, the other of said first lock bolts extending through said second positioning hole in said connecting rod to engage said engaging hole in said magazine member.

13. The nail gun as claimed in claim 12, wherein:

said second positioning portion of said magazine member is configured as a threaded hole; and said connecting rod further has a pair of third and fourth positioning holes disposed between said upper end of said connecting rod and an assembly of said first and second positioning holes; and said nail gun further comprises a second connecting unit for connecting said connecting rod to said second positioning portion of said magazine member, said second connecting unit including two second lock bolts, one of said second lock bolts extending through said fourth positioning hole in said connecting rod to engage said second positioning portion of said magazine member, the other of said lock bolts extending through said third positioning hole in said connecting rod to engage said engaging hole in said magazine member.

14. A nail gun comprising:

a body;

a handle having a proximate end connected fixedly to and extending laterally from said body, and a distal end opposite to said proximate end of said handle;

a nail ejection member connected to and disposed under said body and extending along a vertical direction; and a magazine member having a proximate end connected pivotally to said nail ejection member, and a distal end opposite to said proximate end of said magazine member; and a connecting rod having an upper end connected pivotally to said distal end of said handle, a lower end opposite to said upper end along a longitudinal direction of said connecting rod, a first positioning portion adjacent to said lower end of said connecting rod, and a second positioning portion disposed between said first positioning portion and said upper end, said first and second positioning portions of said connecting rod being spaced apart from each other along the longitudinal direction of said connecting rod;

wherein said magazine member is connectable with both of said first and second positioning portions, such that said magazine member can be connected to either said first or second positioning portion of said connecting rod to allow for an adjustment of said magazine member relative to said nail ejection member between two positions.

15. The nail gun as claimed in claim 14, wherein said first and second positioning portions of said connecting rod are positioned such that, when said magazine member is connected to said first positioning portion, said magazine member is perpendicular to said nail ejection member, and said distal end of said magazine member is spaced apart from said distal end of said handle, and when said magazine member is connected to said second positioning portion, said connecting rod abuts against said magazine member along a full length thereof, and said distal end of said magazine member is adjacent to said distal end of said handle.

16. The nail gun as claimed in claim 15, further comprising a quick release latch disposed on said magazine member, said connecting rod being formed with a first positioning groove formed in said lower end and constituting said first positioning portion, and a second positioning groove constituting said second positioning portion, said quick release latch being engageable with a selected one of said first and second positioning grooves in said connecting rod to interconnect said connecting rod and said magazine member.

17. The nail gun as claimed in claim 16, wherein:

said magazine member has a top surface, and a projection disposed on said top surface and formed with a threaded hole; and said quick release latch includes:

a threaded rod portion engaging said threaded hole in said magazine member and the selected one of said first and second positioning grooves in said connecting rod, and a cam lever connected pivotally to an end of said threaded rod portion.

* * * * *